US007455386B2

(12) United States Patent
Ito

(10) Patent No.: US 7,455,386 B2
(45) Date of Patent: Nov. 25, 2008

(54) INKJET-RECORDING-HEAD FLUSHING METHOD

(75) Inventor: Masaharu Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 315 days.

(21) Appl. No.: 11/276,343

(22) Filed: Feb. 24, 2006

(65) Prior Publication Data

US 2006/0187257 A1 Aug. 24, 2006

(30) Foreign Application Priority Data

Feb. 24, 2005 (JP) ..... 2005-048516

(51) Int. Cl.
*B41J 2/165* (2006.01)
*B41J 29/38* (2006.01)

(52) U.S. Cl. ..... 347/35; 347/29; 347/30; 347/32; 347/10

(58) Field of Classification Search ..... 347/23, 347/24, 29, 30, 32, 33, 10, 11, 35
See application file for complete search history.

(56) References Cited

U.S. PATENT DOCUMENTS 5,428,380 A * 6/1995 Ebisawa ..... 347/35
5,530,462 A * 6/1996 Takahashi et al. ..... 347/23
6,033,050 A 3/2000 Morita et al.
6,257,696 B1 * 7/2001 Nakamura ..... 347/30
6,488,354 B2 * 12/2002 Hosono ..... 347/23
6,736,482 B1 * 5/2004 Suzuki ..... 347/23
6,746,100 B2 6/2004 Imai et al.
6,802,589 B2 * 10/2004 Yonekubo et al. ..... 347/29
2002/0191039 A1 * 12/2002 Minowa

FOREIGN PATENT DOCUMENTS

JP H06-039163 B2 5/1994
JP 2741017 B2 1/1998
JP 2002-036594 A 2/2002
JP 3332569 B2 7/2002

* cited by examiner

*Primary Examiner*—Shih-wen Hsieh
(74) *Attorney, Agent, or Firm*—Baker Botts L.L.P.

(57) ABSTRACT

A method of flushing a nozzle of an inkjet recording head so as to recover an ink-ejection performance of the nozzle. The nozzle ejects, in a recording mode of the inkjet recording head, a plurality of droplets of an ink to record dot images, such that each of the droplets has an arbitrary one of a plurality of volumes. The flushing method includes causing the inkjet recording head to perform, for a first time, a plurality of continuous flushing actions in each of which the nozzle attempts to eject a droplet of the ink whose volume is larger than a smallest volume of the plurality of volumes, and causing the inkjet recording head to repeat, at least one more time, the plurality of continuous flushing actions while interposing a pause time between each pair of consecutive times out of the first time and said at least one more time.

23 Claims, 11 Drawing Sheets

FIG.6

REPETITION NUMBER (TIMES) FOR RECOVERY OF INK-EJECTION PERFORMANCE

| INK-DROPLET VOLUME | DRIVE FREQUENCY | | | |
|---|---|---|---|---|
| | 1/1 | 1/2 | 1/3 | 1/4 |
| P8 | 10 | 12 | 14 | 16 |
| P16 | 9 | 10 | 10 | 12 |
| P24 | 5 | 6 | 8 | 12 |
| P35 | 4 | 6 | 8 | 10 |

FIG.7

OCCURRENCE OF SPOT PHENOMENON AT 10°C

| INK-DROPLET VOLUME | DRIVE FREQUENCY | | | |
|---|---|---|---|---|
| | 1/1 | 1/2 | 1/3 | 1/4 |
| P8 | ○ | ○ | ○ | ○ |
| P16 | × | ○ | ○ | ○ |
| P24 | × | ○ | ○ | ○ |
| P35 | × | × | ○ | ○ |

FIG.8

RELATIONSHIP BETWEEN CONTINUOUS-EJECTION NUMBER AND RECOVERY OF INK-EJECTION PERFORMANCE

| CONTINUOUS-EJECTION NUMBER | RECOVERY |
|---|---|
| 60 | × |
| 120 | × |
| 160 | ○ |
| 200 | ○ |
| 400 | ○ |
| 600 | ○ |

FIG.9

RELATIONSHIP BETWEEN ELAPSE TIME AND REPETITION NUMBER FOR RECOVERY OF INK-EJECTION PERFORMANCE

| ELAPSE TIME t (seconds) | REPETITION NUMBER (times) |
|---|---|
| 300 TO 1,200 | 4 |
| 1,200 TO 2,700 | 6 |
| 2,700 TO 3,600 | 7 |
| 3,600 TO 10,800 | 8 |
| 10,800 TO 21,600 | 6 |
| 21,600 TO 43,200 | 4 |

INKJET-RECORDING-HEAD FLUSHING METHOD

The present application is based on Japanese Patent Application No. 2005-048516 filed on Feb. 24, 2005, the contents of which are incorporated herein by reference.

BACKGROUND OF THE INVENTION

1. Field of the Invention

The present invention relates to a method of flushing a nozzle of an inkjet recording head of an inkjet recording apparatus that ejects droplets of an ink containing a pigment toward a recording medium to record an image thereon, by ejecting, from the nozzle, droplets of the ink to recover an ink-ejection performance of the nozzle.

2. Discussion of Related Art

A conventional inkjet recording apparatus has such a problem that a nozzle of an inkjet recording head thereof may fail to eject normally droplets of ink because the ink dries around a nozzle-opening surface of the head or a viscosity of the ink increases in a low-temperature environment, i.e., because energy needed to eject the ink droplets increases because of the increased viscosity resistance. To solve this problem, Japanese Patent Document No. 6-39163, for example, proposes to carry out a maintenance operation, i.e., a flushing operation of removing, from a nozzle, bad ink having increased viscosity so as to recover an ink-ejection performance of the nozzle. More specifically explained, the flushing operation includes (a) moving, based on a time measured by a timer, or upon reception of a command signal, the inkjet recording head to a waste-ink collecting portion and (b) operating the head to attempt to eject a predetermined number of ink droplets.

Meanwhile, two sorts of inks, i.e., a dye ink and a pigment ink may be used in an inkjet recording apparatus. The dye ink contains a solvent and a dye dissolved in the solvent, and enjoys a good color development and a fine hue expression. Therefore, the dye ink can be used to record, e.g., photographs with high quality. However, in the case where the dye ink is used with plain paper, it may bleed. On the other hand, the pigment ink contains a color material that is not dissolved in a liquid but is dispersed therein. Thus, the pigment ink enjoys a high water resistance and does not bleed into plain paper. In particular, in the case where a black pigment ink is used, the black ink enjoys an increased degree of density and accordingly a black image recorded with the black ink enjoys a high degree of clarity. Thus, there have been proposals that an inkjet recording apparatus record images with higher quality by using a pigment ink as a black ink in combination with one or more dye inks as one or more color inks, or using pigment inks only.

SUMMARY OF THE INVENTION

However, in the case where a pigment ink is used, if a recording head is kept, when being not in use, such that a nozzle-opening surface thereof in which a nozzle opens is covered with a cap, the ink dries around the nozzle-opening surface in a considerably short time. In this case, an ink-ejection performance of the nozzle cannot be recovered unless it is subjected to a long flushing operation in which it attempts to eject a great number of ink droplets. This problem is more likely to occur to nozzles having smaller diameters.

FIG. 11 illustrates a condition of a pigment ink 98 that has dried around a nozzle-opening surface 99*a* of an inkjet recording head 99. More specifically explained, the pigment ink 98 is more likely to dry than a dye ink, and a pigment component 98*a* of the ink 98 aggregates in the vicinity of the nozzle-opening surface 99*a* of the head 99, so that a viscous ink 98*b* having an increased viscosity is produced in a nozzle 99*b*. The viscous ink 98*b* increases a resistance to ejection of a droplet of the pigment ink 98 from the nozzle 99*b*. Thus, the nozzle 99*b* needs to carry out a long flushing operation, i.e., attempt to eject a great number of ink droplets each having a large volume, so as to remove the viscous ink 98*b*. However, the long flushing operation wastes a large volume of the pigment ink 98 and needs a long operation time. In addition, if the long flushing operation is carried out in a low-temperature environment, the nozzle-opening surface 99*a* of the inkjet recording head 99 is likely to wet, and may even suck air bubbles to fail to eject ink droplets.

It is therefore an object of the present invention to solve at least one of the above-indicated problems. It is another object of the present invention to provide a flushing method that can efficiently recover an ink-ejection performance of at least one ink-ejection nozzle that ejects an ink that may contain a pigment.

The above objects may be achieved by the present invention according to which there is provided a method of flushing a nozzle of an inkjet recording head so as to recover an ink-ejection performance of the nozzle. The nozzle ejects, in a recording mode of the inkjet recording head, a plurality of droplets of an ink to record dot images, such that each of the droplets has an arbitrary one of a plurality of volumes. The flushing method comprises causing the inkjet recording head to perform, for a first time, a plurality of continuous flushing actions in each of which the nozzle attempts to eject a droplet of the ink whose volume is larger than a smallest volume of the plurality of volumes, and causing the inkjet recording head to repeat, at least one more time, the plurality of continuous flushing actions while interposing a pause time between each pair of consecutive times out of the first time and said at least one more time.

In the present flushing method, the nozzle of the inkjet recording head is flushed by performing the continuous flushing actions in each of which the nozzle attempts to eject a droplet of the ink whose volume is larger than the smallest volume of the plurality of volumes that are used in the recording mode. Therefore, bad ink whose viscosity has increased can be efficiently removed, with great forces, from the nozzle. In addition, since the ink droplets each having the large volume are continuously applied to the nozzle, the great forces are continuously applied to the bad ink so as to remove the ink. Thus, the bad ink can be efficiently expelled from the nozzle. Moreover, since the pause time or times is or are provided, the changes of the pressure applied to the meniscus formed by the surface tension of the ink at an open end of the nozzle, can be effectively reduced. Thus, the ink droplets can be easily ejected from the nozzle. Furthermore, since the series of continuous flushing actions is repeated one or more times, the bad ink can be removed with high reliability. Consequently the time duration needed to carry out the flushing operation can be shortened, and the amount of consumption of the ink can be reduced, so that the ink-ejection performance of the nozzle can be efficiently recovered to its normal condition. In particular, in the case where the ink is a pigment ink containing a pigment, the interposition of the above-indicated pause time or times leads to dispersing effectively the pigment component whose concentration has increased around a nozzle-opening surface of the inkjet recording head, so that the ink droplets can be easily ejected from the nozzle.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 6 is a table showing a relationship between (a) each of ink-droplet volume and drive frequency and (b) number of repetition times needed to recover ink-ejection performance of the nozzles, with respect to conditions of a flushing operation at ordinary temperatures;

FIG. 7 is a table showing occurrence of a "spot" phenomenon after a flushing operation is performed at a low temperature of 10° C. to recover the ink-ejection performance of the nozzles;

FIG. 8 is a table showing a relationship between number of continuous flushing actions (i.e., continuous ink ejections) and recovery of ink-ejection performance of the nozzles;

FIG. 9 is a table showing a relationship between elapse time from the time when the last flushing operation is carried out to the time when a new recording-operation command is inputted, and number of repetition times needed to recover the ink-ejection performance of the nozzles;

DETAILED DESCRIPTION OF THE PREFERRED EMBODIMENTS

Figure 1:
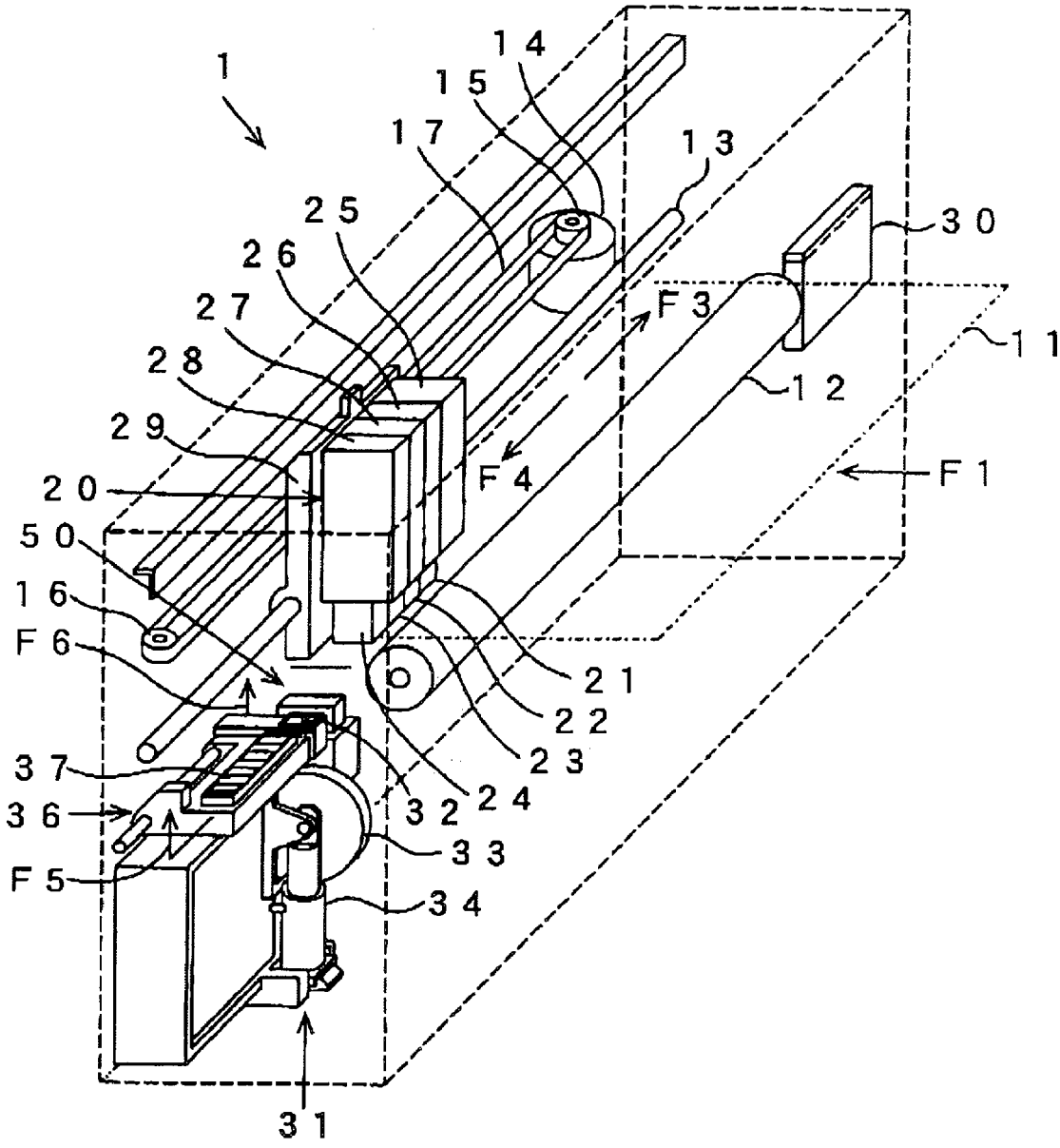
FIG. 1 is an illustrative view of a portion of an inner construction of an inkjet printer as a portion of an inkjet recording system to which the present invention is applied.

FIG. 1 shows a relevant portion of an inner construction of an inkjet printer 1 as a portion of an inkjet recording system that carries out a flushing method embodying the present invention. The following description relates to a piezoelectric-type inkjet printer 1 in which a piezoelectric effect of a piezoelectric element is utilized to eject droplets of ink, but the principle of the present invention is applicable to other sorts of inkjet recording apparatuses. Hereinafter, the inkjet printer 1 will be simply referred to as the printer 1.

<Construction of Printer 1>

The printer 1 includes a platen roller 12 that feeds a recording sheet 11 as a sort of recording medium that is fed in a direction indicated by arrow, F1, in FIG. 1; a carriage-support axis member 13 that extends parallel to an axis line of the platen roller 12; and a carriage 29 which is supported by the axis member 13 and on which an inkjet recording head 20 is mounted. A carriage motor 14 is provided in the vicinity of one of opposite ends of the axis member 13; and a driven pulley 16 is provided in the vicinity of the other end of the axis member 13. A drive pulley 15 is fixed to an output shaft of the carriage motor 14, and an endless belt 17 is wound on the two pulleys 15, 16.

The carriage 29 is secured to the endless belt 17. When the carriage motor 14 is driven or rotated, the carriage 29 is slid or moved on the axis member 13 in each of opposite directions respectively indicated by arrows, F3 and F4, in FIG. 1, while traversing the recording sheet 11.

The inkjet recording head 20 includes a black-ink ejecting head portion 21 that ejects droplets of a black ink; a yellow-ink ejecting head portion 22 that ejects droplets of a yellow ink; a cyan-ink ejecting head portion 23 that ejects droplets of a cyan ink; and a magenta-ink ejecting head portion 24 that ejects droplets of a magenta ink. The black-ink head portion 21, the yellow-ink head portion 22, the cyan-ink head portion 23, and the magenta-ink head portion 24 are supplied with the black ink, the yellow ink, the cyan ink, and the magenta ink from four ink cartridges 25, 26, 27, 28, respectively, each as an ink supplying device.

The back ink is a "pigment" ink containing a black pigment for the purpose of recording clear monochromatic images such as characters. On the other hand, each of the yellow ink, the cyan ink, and the magenta ink is a "dye" ink containing a corresponding color dye for the purpose of recording high-quality chromatic images such as full-color photographs.

Figure 4A:
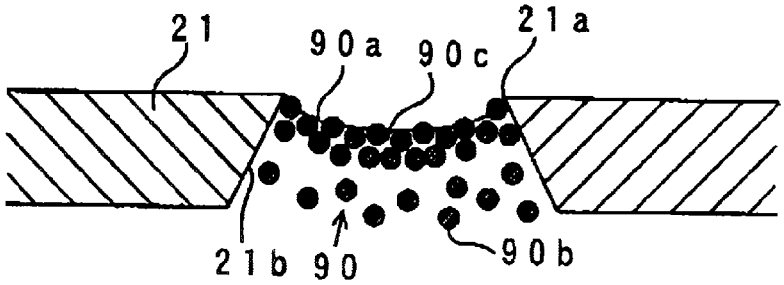
FIG. 4A is an illustrative view showing a state of a meniscus of the black ink when the ink dries after a nozzle-opening surface of the inkjet recording head is kept covered with a cap 37 in a state in which the head is not carrying out a recording operation.
Figure 4B:
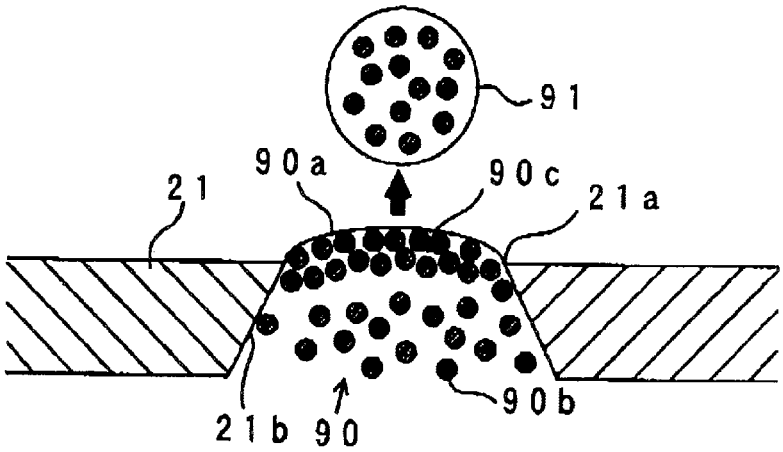
FIG. 4B is an illustrative view showing a state of the meniscus of the black ink when the inkjet recording head is performing the continuous flushing actions.
Figure 4C:
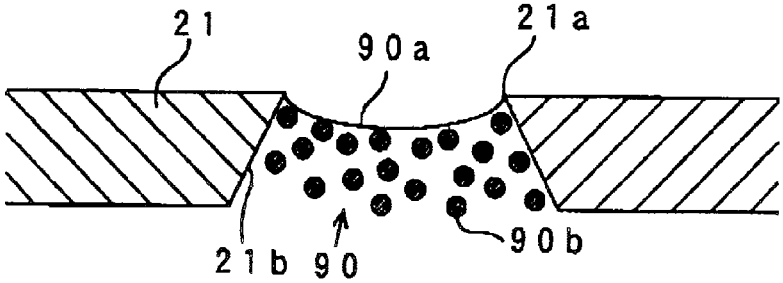
FIG. 4C is an illustrative view showing a state of the meniscus of the black ink when a pause time is interposed after the continuous flushing actions are performed.

Each of the four ink-ejecting head portions 21, 22, 23, 24 has a plurality of ink chambers, not shown, that temporarily accommodate a corresponding one of the four inks respectively supplied from the four cartridges 25, 26, 27, 28 and that respectively communicate with a plurality of ink-ejection nozzles (only the ink-ejection nozzles 21*b* of the black-ink ejecting head portion 21 are shown in FIGS. 4A through 4C) each of which opens in an outer surface of the each ejecting head portion 21, 22, 23, 24 that is opposed to the platen roller 12, and ejects droplets of the ink supplied from a corresponding one of the ink chambers. In the present embodiment, each of the ink-ejection nozzles has a diameter of 22 μm. A portion of walls defining each one of the ink chambers is formed as a piezoelectric element. When a drive voltage is applied to an arbitrary one of the piezoelectric elements respectively corresponding to the ink chambers, a volume of the ink chamber corresponding to the arbitrary piezoelectric element is changed, so that the ink-ejection nozzle communicating with the ink chamber ejects a droplet of the ink toward the recording sheet 11 so as, to record a dot image on the sheet 11.

In the vicinity of one of opposite ends of the platen roller 12, beyond a recording range in which the recording head 20 is allowed to record dot images on each recording sheet 11, there is provided an ink absorbing pad 30 that is formed of a porous material and that absorbs droplets of the ink ejected by each of the four ink-ejecting head portions 21 through 24 when the each ink-ejecting head portion 21, 22, 23, 24 carries out a flushing operation to remove the bad ink and thereby recover an ink-ejection performance of the each ink-ejecting head portion. The flushing operation is carried out before the inkjet recording head 20 starts a recording operation in a recording mode thereof, and is periodically carried out during the recording operation. Owing to the flushing operations, the ink present in the nozzles of each of the ink ejecting head portions 21 through 24 can be prevented from drying, and accordingly the nozzles can be prevented from failing to eject droplets of the ink because of drying of the ink.

In the vicinity of the other end of the platen roller 12, beyond the above-described recording range, there is provided a purging device 31 that recovers an ink-ejection performance of the ink-ejecting head portions 21 through 24 so that those head portions 21 through 24 may not fail to eject ink droplets. More specifically described, the purging device 31 includes a suction cap 32 that is moved, owing to rotation of a cam 33, toward the inkjet recording head 20, being positioned at a purging position, in a direction indicated by arrow, F6, so that the suction cap 32 selectively covers a desired one of the respective outer surfaces (i.e., respective nozzle-opening surfaces) of the four ink-ejecting head portions 21 through 24. When a pump 34 is driven or operated to produce a negative pressure, the purging device 31 sucks, through the suction cap 32, bad ink containing air bubbles, from the ink chambers of each of the ink-ejecting head portions 21 through 24 via the corresponding ink-ejection nozzles. Thus, the purging device 31 recovers the ink-ejection performance of each ink-ejecting head portion 21, 22, 23, 24.

A wiper member 50 is provided adjacent to the suction cap 32. The wiper member 50 wipes off ink or foreign matter that is adhered to the nozzle-opening surface of each ink-ejecting head portion 21, 22, 23, 24, after the purging device 31 carries out the above-described purging operation for the each ink-ejecting head portion. At a timing when the purging operation is finished with respect to each ink-ejecting head portion 21, 22, 23, 24, the wiper member 50 is moved in the direction indicated by arrow F6, so as to wipe the nozzle-opening surface of the each ink-ejecting head portion being moved toward the recording range. Thus, the adhered ink is removed from the nozzle-opening surface of each ink-ejecting head portion 21, 22, 23, 24, and accordingly a recording surface of the recording sheet 11 is prevented from being soiled of the ink.

A capping device 36 is provided outside of and adjacent to, the suction cap 32. The capping device 36 includes caps 37 that cover the respective nozzle-opening surfaces of the four ink-ejecting head portions 21, 22, 23, 24 of the inkjet recording head 20 being positioned at a home position. When the inkjet recording head 20 is positioned at the home position, the caps 37 are moved in a direction indicated by arrow, F5, so as to cover the respective nozzle-opening surfaces of the four ink-ejecting head portions 21 through 24. Thus, the inks present in the ink-ejecting head portions 21 through 24 are prevented from drying, when the printer 1 is not in use.

<Control Device>

Figure 2:
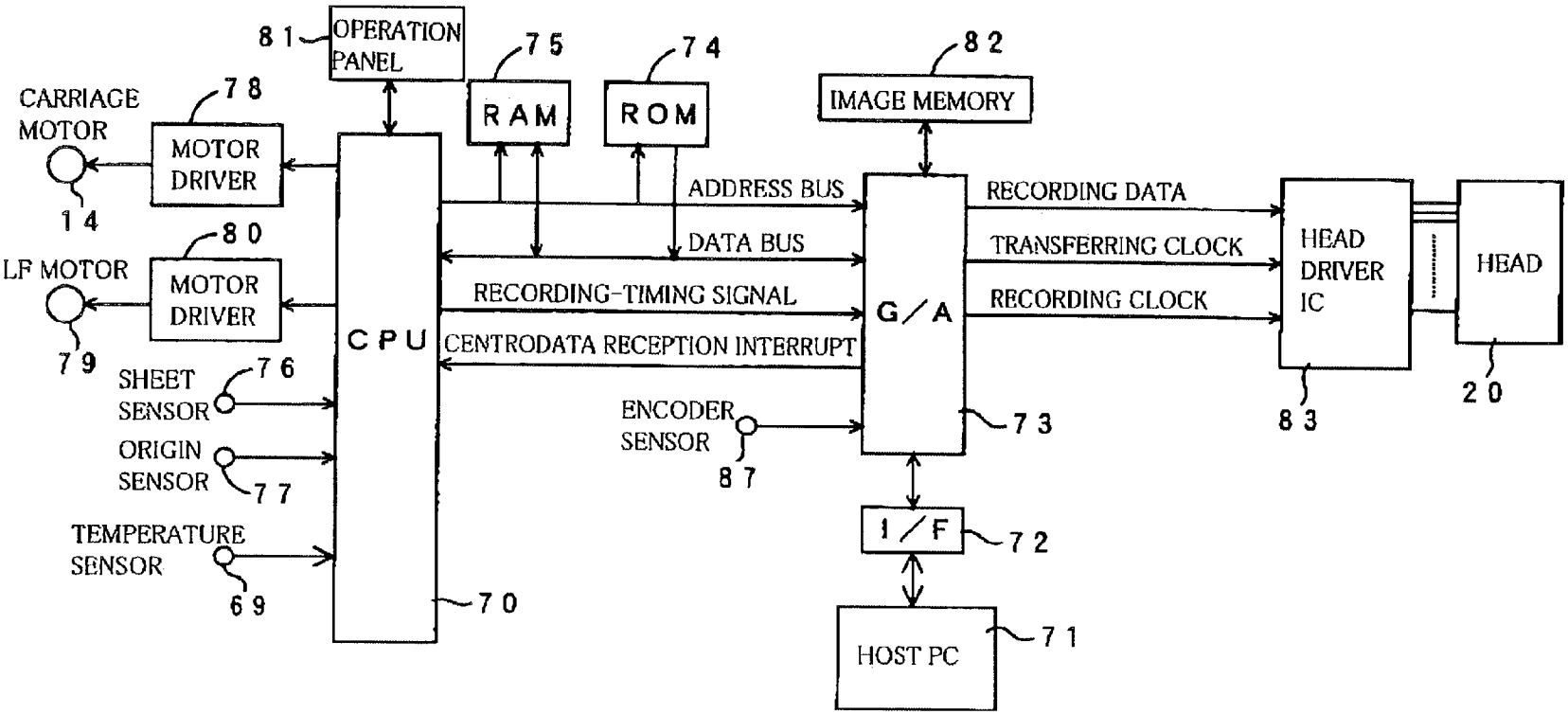
FIG. 2 is a block diagram of the inkjet recording system including, in addition to the inkjet printer, a host personal computer (i.e., host PC) that is operatively connected to the printer.

Next, a control device of the printer 1 will be described by reference to FIG. 2. As shown in FIG. 2, the control device of the printer 1 includes a computer including a CPU (central processing unit) 70, an interface (I/F) 72, a gate array (G/A) 73, a ROM (read only memory) 74, and a RAM (random access memory) 75. The host PC 71 is connected to the I/F 72. The CPU 70 operates for outputting a recording-operation command and a flushing-operation command each to the inkjet recording head 20, and outputting a purging-operation command to the purging device 31. The G/A 73 receives, from the host PC 71, recording data via the I/F 72, and controls development of the received recording data. The ROM 74 stores various control programs such as a flushing-control program represented by the flow chart of FIG. 10, and various control data such as flushing-control data (e.g., a continuous-ejection number, N, and a pause time, t1, each described later). The RAM 75 temporarily stores various data such as the control data, when the CPU 70 implements the control programs. The CPU 70 communicates various data with the ROM 74 and the RAM 75.

The CPU 70 outputs a recording-timing signal 88 to the G/A 73, and the G/A 73 outputs, based on the recording-timing signal 88, a recording clock 86 having a corresponding frequency, f, to a head driver IC (integrated circuit) 83 that drives the inkjet recording head 20. The frequency f of the recording clock 86 indicates timings at which drive pulse signals are applied to the inkjet recording head 20, and this frequency f can be changed by changing the recording-timing signal 88.

The head driver IC 83 operates, based on the recording data 84, a transferring clock 85, and the recording clock 86, each received from the G/A 73, for driving the inkjet recording head 20. In addition, the G/A 73 is connected to an image-data memory 82 that temporarily stores, as image data, the recording data received from the host PC 71, and is connected to an encoder sensor 87 that generates pulses signals indicating the movement of the carriage 29.

A portion of the computer including the CPU 70, the ROM 74, and the RAM 75 constitutes a timer, T, that measures an elapse time, t, from a time when the inkjet recording head 20 carries out a last flushing operation to a time when the CPU 70 outputs a new recording-operation command to the recording head 20. The ROM 74 stores a flushing-control-data memory area, not shown, that stores the above-indicated flushing-control data. Even if supplying of electric power to the printer 1 may be stopped, the timer T continues measuring the above-described elapse time t after the last flushing operation.

The CPU 70 is connected to a sheet sensor 76, an origin sensor 77, a first motor driver 78, a second motor driver 79, and an operation panel 81. The sheet sensor 76 detects whether any recording sheets 11 are left. The origin sensor 77 detects whether the inkjet recording head 20 is positioned at the above-described home position. The first motor driver 78 drives the carriage motor 14. The second motor driver 80 drives a line feed (LF) motor 79 that rotates the platen roller 12. The operation panel 81 is manually operable by a user to input various commands to the CPU 70.

<Drive Waveforms for Recording Operation>

Figures 3A, 3B:
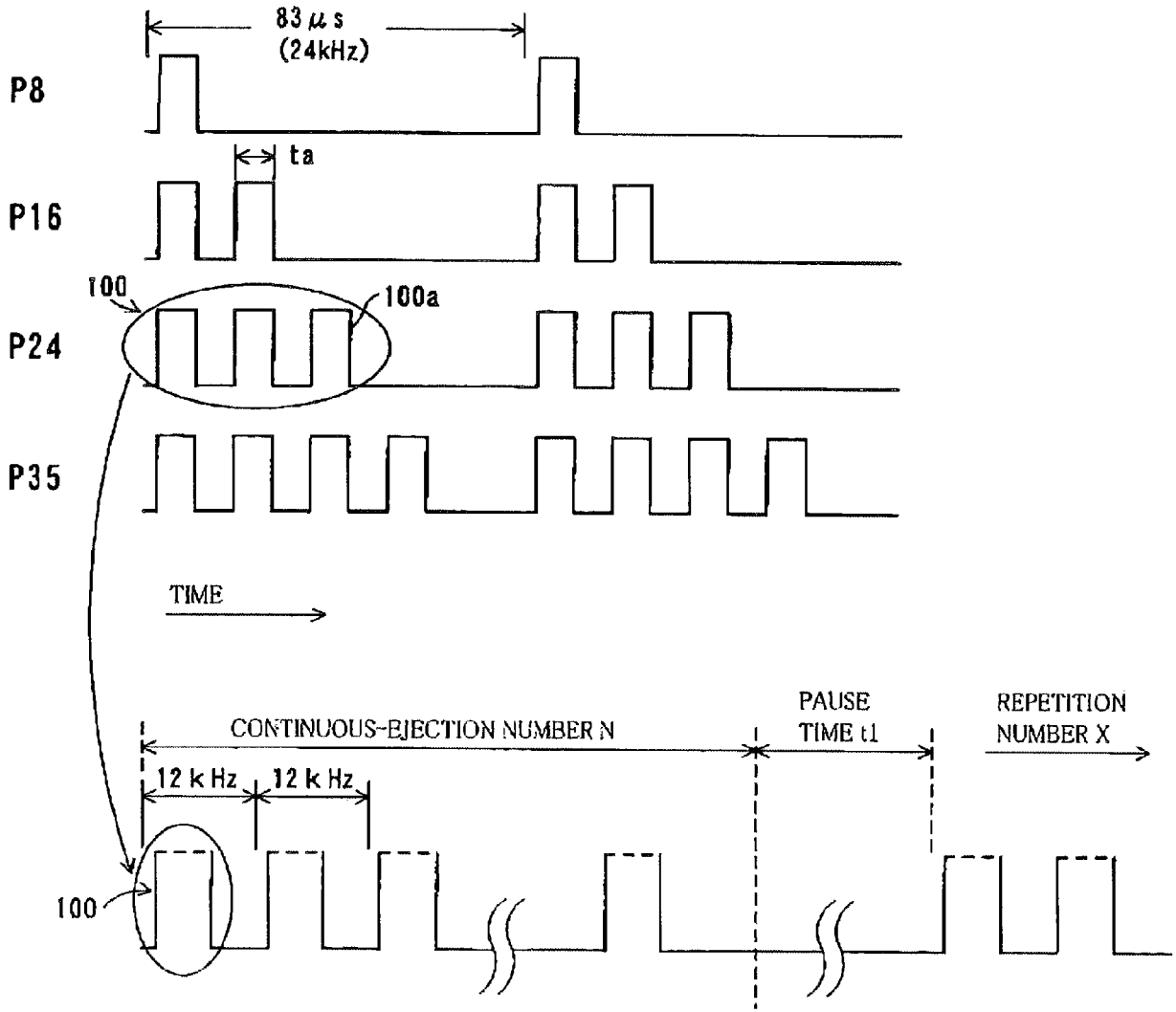
FIG. 3A is a time chart showing four sorts of drive waveforms each of which includes one or more drive pulses to drive an inkjet recording head to eject, in a recording mode thereof, a droplet of an ink to record a dot image on a recording medium.
FIG. 3B is a time chart showing a drive waveform to drive the inkjet recording head to attempt to eject, in a flushing operation, a droplet of a pigment black ink in each of continuous flushing actions of the flushing operation.

In the recording mode of the inkjet recording head 20, the recording head 20 records, based on a selected one of a plurality of sorts of drive waveforms, shown in FIG. 3A, dot images on a recording sheet 11. The different sorts of drive waveforms correspond to different volumes of an ink droplet that is ejected from the recording head 20 to record one dot on the recording sheet 11. In the present embodiment, four sorts of drive waveforms corresponding to four different ink-droplet volumes, i.e., 8 picolitters (P8), 16 picolitters (P16), 24 picolitters (P24), and 35 picolitters (P35) are employed. The ink-droplet volume can be changed by changing a total number of drive pulse(s) 100*a* that is or are generated based on a one-dot recording command. For example, the 8-picolitter volume (P8) corresponds to one drive pulse 100*a*; and the 35-picolitter volume (P35) corresponds to four drive pulses 100*a*. However, the ink-droplet volume may be changed by changing a width, ta, or an electric voltage, of a single drive pulse.

A highest drive frequency of three drive frequencies (i.e., 12 kHz, 20 kHz, and 24 kHz) that can be used, in the recording mode, as the frequency of the recording clock 86 is 24 kHz.

<Conditions of Flushing Operation>

Experiments were carried out to determine conditions of a flushing operation to flush the black-ink ejecting head portion 21 that ejects droplets of the pigment black ink. Those experiments will be described by reference to FIGS. 3A, 3B, 4A, 4B, 4C, and 5 through 9. The pigment black ink 90 (FIGS. 4A through 4C) is more likely to dry than the other, dye inks. Therefore, even if the elapse time t after the last flushing operation may be considerably short, a pigment component 90*b* of the black ink 90 may aggregate, as shown in FIG. 4A, to a meniscus 90*a* of the back ink 90 that is formed in the vicinity of a nozzle-opening surface 21*a* of the black-ink ejecting head portion 21, so that a viscous ink 90*c* having an increased viscosity is produced in the meniscus 90*a*. This viscous ink 90*c* must be efficiently removed to recover an ink-ejection performance of an ink-ejection nozzle 21*b* opening in the surface 21*a*. To this end, the flushing operation needs to be carried out under appropriate conditions.

Figure 5:
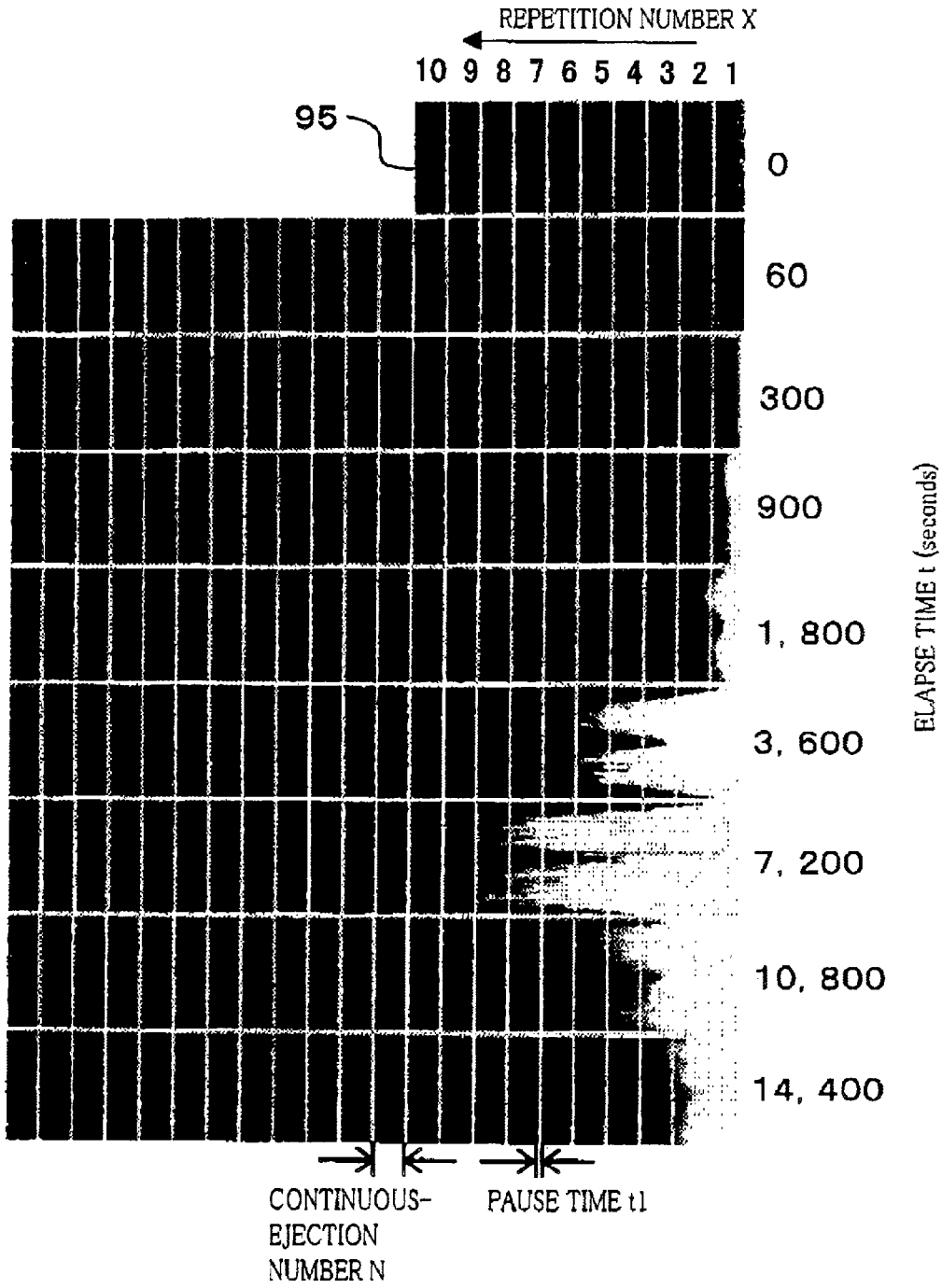
FIG. 5 is a graph showing a relationship between elapse time t in which the nozzle-opening surface is kept covered with the cap 37, and recovery of ink-ejection performance of nozzles of the inkjet recording head.

The experiments of the Inventor were carried out as follows: First, it is confirmed that all the nozzles 21*b* of the black-ink ejecting head portion 21 have normally carried out a flushing operation. Then, the nozzle-opening surface 21*a* of the black-ink ejecting head portion 21 is kept covered with the corresponding cap 37 for an appropriate time duration. Subsequently, the cap 37 is removed from the nozzle-opening surface 21*a*, and all the nozzles 21*b* are controlled to carry out a flushing operation again. As shown in FIG. 5, results of this first experiment indicate that in a short range of elapse time t (seconds) that is shorter than 300 seconds, all the nozzles 21*b* have normally ejected ink droplets, and that in an intermediate range of elapse time t that is longer than 300 seconds and shorter than 43,200 seconds (not shown), the nozzles 21*b* have failed to eject ink droplets in an initial time period of the flushing operation. More specifically described, "white" portions of a judgment pattern 95, shown in FIG. 5, indicate that the nozzles 21*b* have failed to eject ink droplets. In the intermediate range, however, the nozzles 21*b* have succeeded in ejecting ink droplets when a total number of continuous flushing actions is increased. The initial time period in which the nozzles 21*b* fail to eject ink droplets takes, when the elapse time t is equal to about 7,200 seconds, a maximum value, and then decreases; and in a long range of elapse time t that exceeds 43,200 seconds, all the nozzles 21*b* have normally ejected ink droplets even at the commencement of the flushing operation. It is speculated that this result is led by a characteristic nature of the black ink as the pigment ink.

FIG. 3B shows a drive waveform 100 corresponding to the ink-droplet volume P24 that can be used to recover effectively the ink-ejection performance of the nozzles 21*b* with respect to the intermediate range of elapse time t between 300 seconds and 43,200 seconds. In this case, the conditions of the flushing operation include five parameters, i.e., (a) a volume of an ink droplet ejected in each of continuous flushing actions; (b) a drive frequency (or a drive period) at which each ink droplet having that volume is ejected; (c) a number, N, of continuous flushing actions to eject a series of ink droplets; (d) a repetition number, X, by which the series of continuous flushing actions is repeated; and (e) a pause time, t1, between each pair of adjacent series of continuous flushing actions that are adjacent to each other with respect to time.

Qualitatively, the viscous ink 90*c* can be effectively pushed out of each nozzle 21*b*, by applying, to the ink 90*c*, great forces, i.e., ink droplets each having a large volume. In the case where the ink droplets having the large volumes are used, it is preferred to apply those ink droplets at a decreased frequency, for the purposes of avoiding a problem that at low temperatures the nozzles 21*b* may fail to eject ink droplets, and additionally reducing an amount of consumption of the black ink 90.

In addition, it is advantageous to apply ink droplets continuously If ink droplets are continuously applied to the viscous ink 90*c*, the pushing force is substantially continuously applied to the ink 90*c*, so that the ink 90*c* can be efficiently removed from the nozzles 21*b*.

In addition, it is preferred to repeat the continuous flushing actions, two or more times, such that a pause time t1 is provided between each pair of adjacent series of continuous flushing actions that are adjacent to each other with respect to time. The pause time t1 is sufficiently longer than the drive period at which the drive waveforms 100 are produced to carry out the continuous flushing actions, respectively, and is not longer than 1 second. In this case, fluctuations of the pressure in the meniscus 90*a* (FIGS. 4A through 4C) are reduced, and accordingly the nozzles 21*b* can be prevented from failing to eject ink droplets. In addition, as shown in FIG. 4B, the pigment component 90*b* may locally gather, i.e., aggregate to the meniscus 90*a* because of the continuous flushing actions to eject ink droplets 91. However, since the pause time t1 is employed, the black ink 90 is uniformly dispersed, so that a viscosity of the black ink 90 in the vicinity of the meniscus 90*a* can be lowered. Thus, the black ink 90 can be more easily ejected.

If the above-described continuous flushing actions are repeated two or more times, the viscous ink 90*c* can be removed with reliability. Thus, the pigment black ink 90 can be easily flushed away from the nozzles 21*b*.

From the above-indicated explanations, it can be qualitatively said that the larger the volume of each ink droplet is, or the higher the drive frequency is, the shorter flushing time is needed to recover the ink-ejection performance of the nozzles 21*b*, and that the greater the number N of the continuous flushing actions is, the more reliably the ink-ejection performance of the nozzles 21*b* can be recovered.

On the other hand, as the volume of each ink droplet increases, the amount of consumption of the black ink 90 also increases. In addition, as the drive frequency increases, the stability of the meniscus 90*c* lowers, in particular in a low-temperature environment, so that the nozzles 21*b* may fail to eject the ink droplets 91. Moreover, as the number N of the continuous flushing actions increases, an increased time is needed to carry out the flushing operation. Furthermore, if the pause time t1 is too long, a long time is needed to carry out the flushing operation, and a viscosity of the black ink 90 present in the vicinity of each nozzle 21*b* increases. On the other hand, if the pause time t1 is too short, the stability of the meniscus 90*c* lowers so that the nozzles 21*b* may fail to eject the ink droplets 91 because the black ink 90 may involve or suck air bubbles.

While respective contributions of the above-indicated five parameters (a) through (e) to the flushing operation are taken into consideration, the conditions of the flushing operation for the case where the black ink 90 as the pigment ink is used, are determined as follows:

<Ink-Droplet Volume and Drive Frequency>

The conditions of the flushing operation are found by recording, as shown in FIG. 5, the judgment patterns 95 representing the results of flushing operations carried out at different elapse times t and observing, with observer's eyes, respective characteristics of the judgment patterns 95.

As described above, the cap 37 is removed from the nozzle-opening surface 21*a* of the black-ink ejecting head portion 21, and the nozzles 21*b* are controlled to carry out a flushing operation again. Each of the rectangular judgment patterns 95 represents one series of continuous flushing actions N (i.e., total number, e.g., N=160) of each of the nozzles 21*b* of the black-ink ejecting head portion 21. The continuous flushing actions N are repeated by X times with a pause time t1 being interposed between each pair of adjacent series of continuous flushing actions N.

The above experiment is carried out for each of (a) different elapse times t (0 second, 60 seconds, 300 seconds, . . . ), (b) each of the four sorts of drive waveforms P8, P16, P24, P35 (FIG. 3A) used in the recording mode, and (c) each of different drive frequencies that are respectively equal to 1/1 (one first), 1/2 (one second), 1/3 (one third), and 1/4 (one fourth) of the highest drive frequency used in the recording mode. The observer judges what times X of repetition of the series of continuous flushing actions N are needed to recover the ink-ejection performance of the nozzles 21*b*. For example, regarding the example shown in FIG. 5, at least eight times of repetition (i.e., X=8) is needed for the case where the elapse time t is 7,200 seconds.

FIG. 6 shows results obtained by repeating, at an ordinary temperature (25° C.), the experiment shown in FIG. 5, five times, and reading the greatest number of the five repetition numbers X observed for each of all possible combinations of (a) four drive frequencies (1/M=1/1, 1/2, 1/3, and 1/4) and (b) four droplet volumes (P8, P16, P24, and P35).

From FIG. 6, it is observed that there is a tendency that the larger the ink-droplet volume is, or the higher the drive frequency is, the smaller the repetition number X needed to recover the ink-ejection performance is. The flushing conditions for the nozzles 21*b* to be able to recover their ink-ejection performance with at most nine times of repetition of the continuous flushing actions, are the following seven combinations:

drive frequency 1/1 →droplet volumes P16, P24, P35 drive frequency 1/2 →droplet volumes P24, P35 drive frequency 1/3 →droplet volumes P24, P35

However, when the inkjet recording head 20 carries out a flushing operation at a low temperature, such a "spot" phenomenon may occur that the nozzles 21*b* as a whole have recovered their ink-ejection performance but some of the nozzles 21*b* fail to eject ink droplets in the recording mode. FIG. 7 shows results obtained by performing, at a low temperature of 10° C., the experiment shown in FIG. 5, so as to confirm that the nozzles 21*b* as a whole have recovered their ink-ejection performance, and subsequently operating, five times, the inkjet recording head 20 to eject ink droplets at the highest drive frequency used in the recording mode. Symbol "X", used in the table of FIG. 7, indicates that the spot phenomenon has occurred; and symbol "○" indicates that the spot phenomenon has not occurred.

As indicated by the results shown in FIG. 7, the conditions for the nozzles 21*b* to be able to recover their ink-ejection performance with at most nine times of repetition, without the occurrence of the spot phenomenon after the flushing operation at the low temperature of 10° C., are the following three combinations:

drive frequency 1/2 →droplet volume P24 drive frequency 1/3 →droplet volumes P24, P35

Each of the three combinations involves the volume P24 or P35 that is not smaller than an average of the smallest volume P8 and the largest volume P35, and the drive frequency 1/2 or 1/3 that is lower than the highest drive frequency, 24 kHz, used in the recording mode.

Thus, it is preferred that the volume of each ink droplet used in the flushing operation fall in a range of from 20 picolitters to 40 picolitters and that the drive frequency used in the flushing operation fall in a range of from 1/2, to 1/3, of the highest one of the plurality of drive frequencies used in the recording mode. However, in view of a need to shorten a time period needed to carry out the flushing operation, it is preferred to use the higher drive frequency and the smaller ink-droplet volume. Therefore, it is most preferred to use the drive frequency 1/2 and the ink-droplet volume P24 (24 picolitters).

<Continuous Flushing Actions>

FIG. 8 shows a relationship between number N of continuous flushing actions per time (i.e., per pattern 95 shown in FIG. 5) and recovery of ink-ejection performance. The conditions of the flushing operation used are the above-indicated most preferable conditions, i.e., the drive frequency 1/2 and the ink-droplet volume P24. FIG. 8 shows results obtained by repeating, eight times (X=8), the continuous flushing actions. The ink-ejection performance of the nozzles 21*b* is not recovered if the number N of the continuous flushing actions is not greater than 120, but is recovered if the number N is not smaller than 160. Thus, it is preferred that the number N of the continuous flushing actions be not smaller than 160. In view of the need to shorten the time period of the flushing operation, a number N of from 160 to 400 is more preferable, and a number N of 200 is most preferable.

<Pause Time>

If the pause time t1 is too long, the flushing operation needs a long time, which may lead to occurrence of such a phenomenon that the viscosity of the black ink 90 around each nozzle 21*b* excessively increases. In view of this, the pause time t1 needs to be not longer than 1 second. On the other hand, if the pause time t1 is too short, the fluctuations of pressure in the meniscus 90*c* may increase, i.e., the stability of the meniscus 90*c* may lower, so that air bubbles may be sucked into each nozzle 21*b*. In view of this, the pause time t1 needs to be not shorter than 0.2 seconds that is sufficiently longer than the drive period at which the continuous flushing actions are performed, i.e. a drive period at which drive waveforms 100 respectively corresponding to the continuous flushing actions are generated. In view of the two factors regarding the time duration of the flushing operation, a pause time t1 of from 0.2 seconds to 0.5 seconds is preferable, and a pause time t1 of 0.3 seconds is most preferable, <Repetition Times>

If the times X of repetition of the continuous flushing actions N are too many, the flushing operation needs a long time and a large amount of consumption of the black ink 90. Thus, it is preferred to minimize the repetition times X. Under a condition that the time duration of the flushing operation is shortened by using the above-described most preferable conditions (i.e., drive frequency 1/2, N=200, and t1=0.3 seconds), the results of the experiment shown in FIG. 5 are inspected with respect to a relationship between elapse time t after the last flushing operation and repetition number X needed to recover the ink-ejection performance. FIG. 9 shows this relationship.

The results shown in FIG. 9 indicate that the repetition number X can be changed depending upon the elapse time t after the last flushing operation. One or more marginal times may be added to the repetition times X corresponding to each of six elapse-time ranges indicated in the table of FIG. 9, in order that the nozzles 21*b* can more reliably recover their ink-ejection performance.

<Preferable Conditions of Flushing Operation>

As is apparent from the foregoing description, the most preferable conditions of the flushing operation for the case where the pigment ink is used and the elapse time t falls in the intermediate range of from 300 seconds to 43,200 seconds, are as follows:

| | |
|---|---|
| droplet volume | P24 |
| drive frequency | 12 kHz (½ of the highest drive frequency used in the recording mode) |
| number N of continuous flushing actions | 200 times |
| pause time t1 | 0.3 seconds |
| number X of repetition times | changeable from 4 times to 8 times |

The droplet volume P24 (24 picolitters) is obtained by using the waveform 100, shown in FIG. 3, that is used to eject an ink droplet whose volume P24 is larger than the smallest volume P8 of the four volumes P8, P16, P24, P35. As shown in FIG. 3B, a waveform 100 including a combination of three drive pulses 100*a* is continuously outputted 200 times at a frequency of 12 kHz, and the continuous flushing actions are repeated appropriate times X while a pause time of 0.3 seconds is interposed between each pair of consecutive series of the continuous flushing actions.

However, in the case the elapse time t is shorter than 300 seconds, the following, short-elapse-time flushing conditions are employed:

| | |
|---|---|
| droplet volume | P8 (8 picolitters) |
| drive frequency | drive frequency used in the last recording operation (12 kHz, 20 kHz, or 24 kHz) |
| number N of continuous flushing actions | this number N increases as elapse time t increases (the upper-limit number is 180) |
| number X of repetition times | one time |

In addition, in the case the elapse time t is longer than 43,200 seconds (i.e., 12 hours), the following, long-elapse-time flushing conditions are used:

| | |
|---|---|
| droplet volume | P24 (24 picolitters) |
| drive frequency | 24 kHz |
| number N of continuous flushing actions | 320 times |
| number X repetition times | 8 times |
| pause time t1 | 0.5 seconds |

Figure 10:
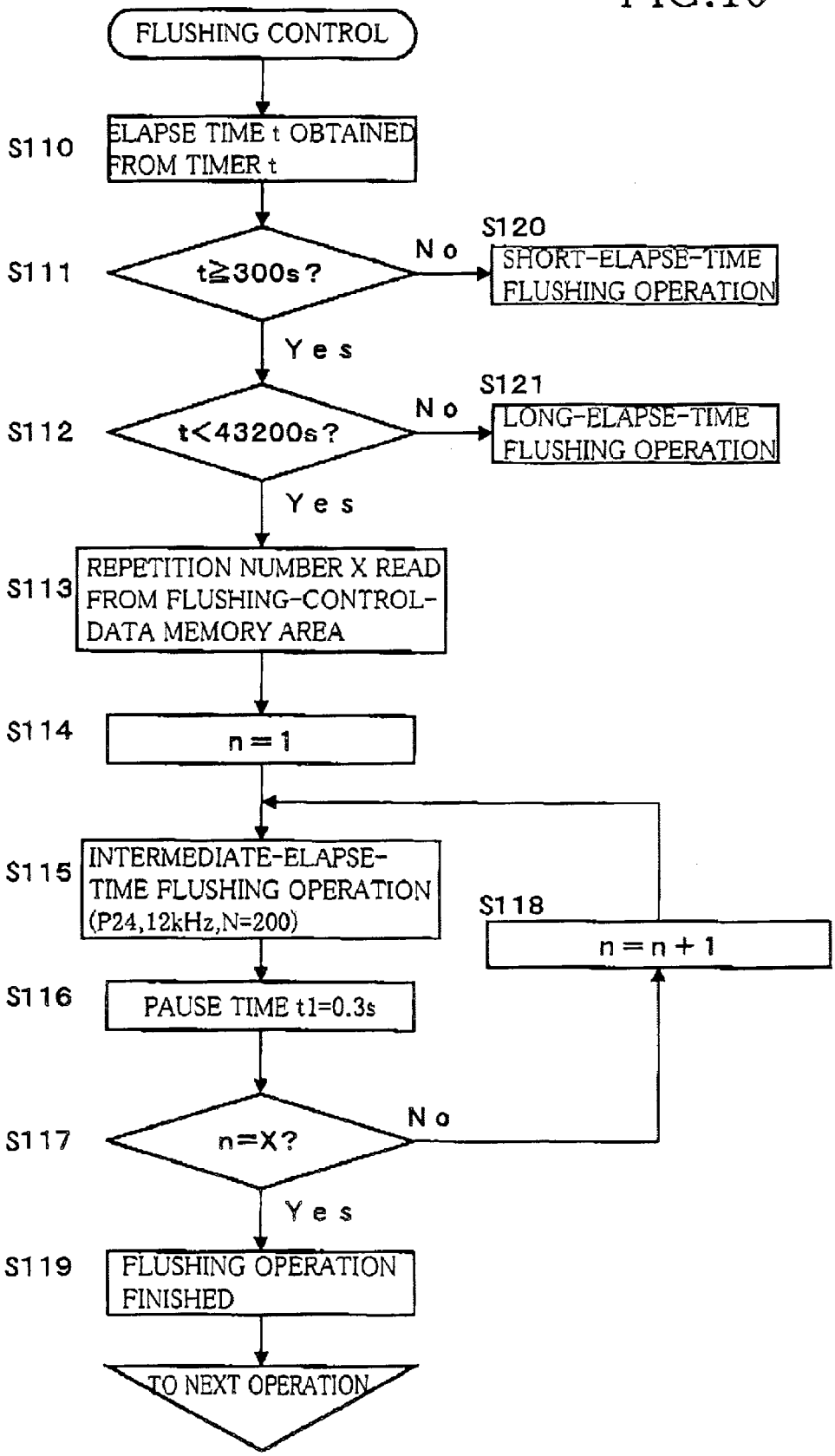
FIG. 10 is a flow chart representing a flushing-operation control program that is implemented by a control device of the inkjet printer.
Figure 11:
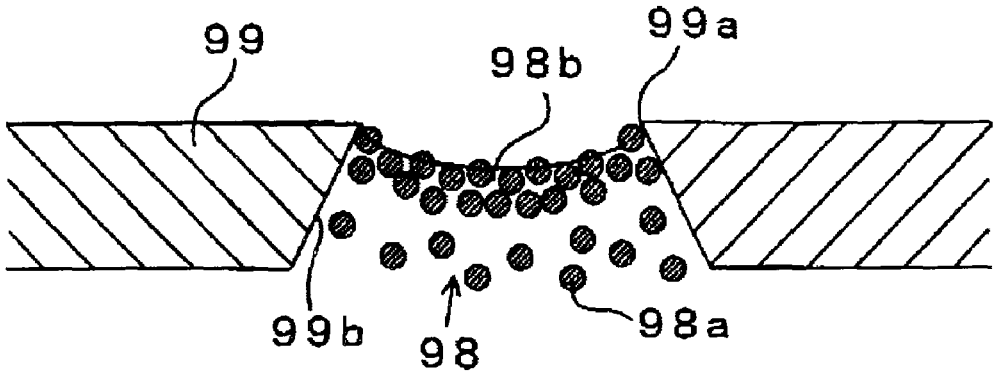
FIG. 11 is an illustrative view showing a state of a pigment ink that has dried in the vicinity of a nozzle-opening surface of a known inkjet recording head.

The flushing-control data representing the above-indicated three sorts of flushing conditions respectively corresponding to the three ranges of elapse time t, are stored in the flashing-control memory area, not shown, of the ROM 74 of the printer 1, and are read from the memory area when the flushing operation is performed according to the control program represented by the flow chart of FIG. 10, described below.

<Flushing Control>

Next, there will be described the flushing operation that is performed under control of the control device including the CPU 70, by reference to the flow chart of FIG. 10.

If a new recording-operation command to carry out a recording operation is inputted to the printer 1, first, the control of the CPU 70 goes to Step S110 to obtain, from a value counted by the timer T, an elapse time t after the last flushing operation is carried out. Step S110 is followed by Step S111 to judge whether the elapse time t is equal to, or longer than, 300 seconds and, if a positive judgment is made at Step S111, the control goes to Step S112 to judge whether the elapse time t is shorter than 43,200 seconds. If a positive judgment is made at Step S112, the control goes to Step S113 to read, from the flushing-control-data memory area of the ROM 74, the repetition number X corresponding to the elapse time t.

Step S113 is followed by Step S114 to set a counter that counts a number, n, indicating current repetition times, to n=1. Then, the control goes to Step S115 to output a drive signal to the carriage motor 14 so as to move the inkjet recording head 20 to a flushing position where the head 20 is opposed to the ink absorbing pad 30, and additionally control the black-ink ejecting head portion 21 to perform the intermediate-elapse-time flushing operation. At Step S115, an ink droplet whose volume is 24 picolitters is continuously ejected 200 times at a drive frequency of 12 kHz, toward the ink absorbing pad 30 and then, at Step S116, a pause time of 0.3 seconds is interposed. Steps S117 and S118 assure that Steps S115 and S116 are repeated by the repetition number X corresponding to the elapse time t. Then, at Step S119, the current flushing operation is finished, and the inkjet recording head starts the recording operation.

On the other hand, if a negative judgment is made at Step S111, the control goes to Step S120 to perform the above-described short-elapse-time flushing operation; and if a negative judgment is made at Step S112, the control goes to Step S121 to perform the above-described long-elapse-time flushing operation.

As is apparent from the foregoing description of the illustrated embodiment, in each of the intermediate-elapse-time flushing operation and the long-elapse-time flushing operation each to flush the black-ink recording head portion 21 that ejects the droplets of the pigment black ink 90, the nozzles 21*b* eject the ink droplets each of which has the volume of 24 picolitters (P24) that is larger than the smallest volume P8 of the four sorts of volumes P8, P16, P24, P35 that can be used in the recording mode. Therefore, the viscous ink 90*c* whose viscosity has increased because off the drying of the ink 90 or the low temperature of the environment, can be efficiently removed from the nozzles 21*b*.

In addition, the continuous flushing actions are performed at the frequency lower than the highest frequency at which the droplets of the black ink 90 are ejected in the recording mode. Therefore, the ink droplets 91 each having the large volume can be ejected with stability. Moreover, since the ink droplets 91 are continuously ejected, pushing forces are continuously applied to the viscous ink 90*c*, so that the viscous ink 90*c* can be efficiently removed. Furthermore, since the pause time or times t1 is or are interposed, the fluctuations of pressure of the meniscus 90*a* of the black ink 90 are effectively reduced, and the pigment component 90*b* whose concentration has increased in the vicinity of the nozzle-opening surface 21*a* is sufficiently dispersed, so that the black ink 90 can be easily ejected. Additionally, since the continuous flushing actions are repeated a plurality of times, the viscous ink 90*c* can be assuredly expelled from the nozzles 21*b*.

Therefore, the amount of consumption of the black ink 90 can be decreased, and the time needed to carry out the flushing operation can: be shortened. Thus, the ink-ejection performance of the nozzles 21*b* that eject the droplets of the pigment black ink 90 can be efficiently recovered to its normal condition.

In particular, in the case where the diameter of the nozzles 21*b* is not larger than 22 μm, the pigment component 90*b* is likely to clog the open end of each nozzle 21*b*. Therefore, the present invention is advantageously applied to those nozzles 21*b*.

Since the number X of the repetition times is so determined as to correspond to the elapse time t, the intermediate-elapse-time flushing operation can be carried out according to the increased degrees of drying or viscosity of the black ink 90. Therefore, as compared with the case where a same or constant repetition number X is used irrespective of the elapse time values t, the amount of consumption of the black ink 90 can be reduced and the flushing time can be shortened.

Since the droplets of the black ink 90 as the basic color of full-color images can be ejected with high reliability, i.e., without failures, high-quality clear images can be recorded.

In the illustrated embodiment, the principle of the present invention is applied to each of (a) the intermediate-elapse-time flushing operation corresponding to the intermediate range of the elapse time t, and (b) the long-elapse-time flushing operation corresponding to the long range of the elapse time t, and is not applied to the short-elapse-time flushing operation corresponding to the short range, because the application of the present invention to the latter flushing operation is not effective. Thus, the two former flushing operations can be efficiently carried out.

The present invention is most efficiently applied to the flushing operation in which the elapse time t falls in the range of from 300 seconds to 43,200 seconds; the volume of each ink droplet falls in the range of from 20 picolitters to 40 picolitters; the drive frequency falls in the range of from one third, to one second, of the highest one of the drive frequencies (e.g., 10 kHz, 20 kHz, 24 kHz) used in the recording mode; the number of the continuous flushing actions falls in the range of from 160 to 400; and the pause time falls in the range of from 0.2 seconds to 0.5 seconds; and the number of repetition times falls in the range of from 5 to 8. A portion of the control device, including the CPU 70, the ROM 74, and the RAM 75, that implements the flushing-control program represented by the flow chart of FIG. 10 constitutes a flushing control portion. The flushing control portion includes (a) a droplet-volume control portion which controls the inkjet recording head 20 such that the volume of each droplet 91 of the black ink 90 falls in the range of from 20 picolitters to 40 picolitters; (b) a flushing-action-number control portion which controls the inkjet recording head 20 such that the total number N of the continuous flushing actions falls in the range of from 160 to 400, (c) a pause-time control portion which controls the inkjet recording head 20 such that the pause time t1 falls in the range of from 0.2 seconds to 0.5 seconds, and (d) a repetition-number control portion which controls the inkjet recording head 20 such that the number X of the repetition times falls in the range of from 5 to 8.

In the illustrated embodiment, the conditions of the flushing operation to flush the nozzles 21*b* of the black-ink ejecting head portion 21 are described. However, for example, in the case where a printer or a recording apparatus uses a plurality of sorts of pigment inks, respective flushing operations to flush respective nozzles to eject those pigment inks may differ from each other, depending upon respective drying speeds and/or viscosities of the inks. In addition, since a drying speed of an ink may change depending upon a temperature of an environment of the ink, the printer 1 as an inkjet recording apparatus may employ a temperature sensor 69 (FIG. 2) that detects a temperature of an environment in which the printer 1 is provided, i.e., the flushing operations are carried out. In this modified case, the above-described flushing-control-data memory area may be modified to store various parameters (i.e., flushing-control data) corresponding to each of the different inks (i.e., colors), each of different elapse-time ranges, and each of different environment-temperature ranges. In this case, too, the printer 1 can enjoy the same advantages as described above.

The principle of the present invention is applicable to such an inkjet recording apparatus that is constituted by a data producing portion (e.g., a host computer such as the host PC 71 shown in FIG. 2) and a recording portion (e.g., a printer such as the printer 1 shown in FIG. 1) that is operatively connected to the data producing portion. In this case, the data producing portion may employ (a) a control device that includes a CPU and a ROM and that can control the recording portion to carry out the flushing operation in accordance with the present invention; and (b) a control program, such as the flushing-control program represented by the flow chart shown in FIG. 10, that can be used by the control device to control the recording portion. The control program may be recorded in a recording medium, such as a magnetic recording medium, such that the control program can be readable by the control device. In this case, too, the inkjet recording apparatus can advantageously carry out the flushing operation as described above.

In the illustrated embodiment, one of the four sorts of drive waveforms used in the recording mode is used as it is in the flushing operation. However, one or more different drive waveforms than the drive waveforms used in the recording mode may be used in the flushing operation. In the latter case, a volume of each of the ink droplets ejected in the flushing operation may not be limited to the same volume as that used in the recording mode.

While the present invention has been described in its preferred embodiment, it is to be understood that the present invention may be otherwise embodied.

For example, while the printer 1 employs the piezoelectric-type inkjet recording head 20, the principle of the present invention is applicable to such a recording apparatus that employs a thermal-type inkjet recording head. In addition, the three elapse-time ranges that are defined by 300 seconds and 43,200 seconds in the illustrated embodiment may be changed, as needed.

In addition, in the illustrated embodiment, the pause time t1 falls in the range of from 0.2 seconds to 1 second, more preferably, in the range of from 0.2 seconds to 0.5 seconds. However, the pause time t1 may be defined using a cycle time of each flushing action performed before the pause time t1. Thus, it is preferred that the pause time t1 fall in the range of from a time corresponding to 1,600 cycles of the continuous flushing actions to a time corresponding to 12,000 cycles of the continuous flushing actions.

In the illustrated embodiment, the control device or the CPU 70 thereof may control the inkjet recording head 20 to flush, in the above-described, short-elapse-time flushing method, i.e., using the short-elapse-time flushing conditions, the nozzles of each of the yellow-ink head portion 22, the cyan-ink head portion 23, and the magenta-ink head portion 24, irrespective of the elapse time t, i.e., with respect to each of the intermediate and long ranges of the elapse time t.

It is to be understood that the present invention may be embodied with other changes and improvements that may occur to a person skilled in the art, without departing from the spirit and scope of the invention defined in the appended claims.

What is claimed is:

1. A method of flushing a nozzle of an inkjet recording head so as to recover an ink-ejection performance of the nozzle, the nozzle ejecting, in a recording mode of the inkjet recording head, a plurality of droplets of an ink to record dot images, such that each of the droplets has an arbitrary one of a plurality of volumes, the flushing method comprising:

causing the inkjet recording head to perform a first series of continuous flushing actions, in each of which action the nozzle attempts to eject a droplet of the ink whose volume is larger than a smallest volume of the plurality of volumes that are used in the recording mode, and causing the inkjet recording head to repeat at least one more series of the continuous flushing actions while interposing a pause time between each pair of consecutive series out of the first series and said at least one more series.

2. The flushing method according to claim 1, wherein the ink contains a pigment.

3. The flushing method according to claim 1, wherein the ink comprises a black ink containing a black pigment.

4. The flushing method according to claim 1, wherein the volume of said droplet of the ink is not smaller than a volume equivalent to an average value of the smallest volume of the plurality of volumes and a largest volume of the plurality of volumes.

5. The flushing method according to claim 4, wherein the volume of said droplet of the ink is smaller than the largest volume 6. The flushing method according to claim 1, wherein the volume of said droplet of the ink falls in a range of from 20 picolitters to 40 picolitters.

7. The flushing method according to claim 1, wherein in the recording mode, the nozzle ejects, at a first frequency, the droplets of the ink so as to record the dot images, and wherein the inkjet recording head is caused to perform the continuous flushing actions at a second frequency lower than the first frequency.

8. The flushing method according to claim 1, wherein in the recording mode, the nozzle ejects, at an arbitrary one of a plurality of first frequencies, the droplets of the ink so as to record the dot images, and wherein the inkjet recording head is caused to perform the continuous flushing actions at a second frequency falling in a range of from one third of a highest first frequency of the plurality of first frequencies to one second of the highest first frequency.

9. The flushing method according to claim 1, wherein a total number of the continuous flushing actions falls in a range of from 160 to 400.

10. The flushing method according to claim 1, wherein the pause time falls in a range of from a time corresponding to 1,600 cycles of the continuous flushing actions to a time corresponding to 12,000 cycles of the continuous flushing actions.

11. The flushing method according to claim 1, wherein the pause time falls in a range of from 0.2 seconds to 0.5 seconds.

12. The flushing method according to claim 1, further comprising:

measuring an elapse time from a time when the flushing method is last carried out, to a time when a new command to operate the inkjet recording head in the recording mode thereof is inputted, and determining, based on the measured elapse time, a number of said at least one more series.

13. The flushing method according to claim 1, wherein a number of said at least one more series falls in a range of from 4 to 7.

14. The method according to claim 1, wherein a diameter of the nozzle is not larger than 22 μm.

15. The method according to claim 1, further comprising:

measuring an elapse time from a time when the flushing method is last carried out, to a time when a new command to operate the inkjet recording head in the recording mode is inputted, and carrying out, when the measured elapse time falls in a reference range, the flushing method, and controlling, when the measured elapse time does not fall in the reference range, the inkjet recording head to perform a plurality of continuous flushing actions in each of which the nozzle attempts to eject a droplet of the ink whose volume is smaller than a largest volume of the plurality of volumes.

16. The method according to claim 15, wherein in the recording modes the nozzle ejects, at a first frequency, the droplets of the ink so as to record the dot images, and wherein when the measured elapse time falls in the reference range of from 300 seconds to 43,200 seconds, the inkjet recording head is caused to perform the continuous flushing actions at a second frequency lower than the first frequency.

17. A method for flushing each of a first nozzle and a second nozzle of an inkjet recording head, so as to recover an ink-ejection performance of said each nozzle, the first nozzle ejecting a plurality of droplets of a first ink containing a pigment, the second nozzle ejecting a plurality of droplets of a second ink containing a dye, the flushing method comprising:

controlling the inkjet recording head to flush the first nozzle by carrying out a first flushing method as the flushing method according to claim 1, and controlling the inkjet recording head to flush the second nozzle by carrying out a second flushing method different from the first flushing method.

18. A computer-readable computer program product, comprising a computer program which is readably by a computer to carry out the flushing method according to claim 1.

19. The computer-readable computer program product according to claim 18, further comprising a recording medium in which the computer program is recorded.

20. A recording system, comprising:

an inkjet recording head having a nozzle which ejects, in a recording mode, a plurality of droplets of an ink so as to record dot images, such that each of the droplets has an arbitrary one of a plurality of volumes; and a control device including a flushing control portion which controls the inkjet recording head to perform, for recovering an ink-ejection performance of the nozzle, a first flushing wherein the inkjet recording head performs a first series of continuous flushing actions, in each of which the nozzle is configured to eject a droplet of the ink whose volume is larger than a smallest volume of the plurality of volumes that are used in the recording mode, and repeats at least one more series of the continuous flushing actions while interposing a pause time between each pair of consecutive series out of the first series, and the at least one more series.

21. The recording system according to claim 20, wherein the flushing control portion comprises at least one of (a) a droplet-volume control portion which controls the inkjet recording head such that the volume of said droplet of the ink falls in a range of from 20 picolitters to 40 picolitters, (b) a flushing-action-number control portion which controls the inkjet recording head such that a total number of the continuous flushing actions falls in a range of from 160 to 400, (c) a pause-time control portion which controls the inkjet recording head such that the pause time falls in a range of from 0.2 seconds to 0.5 seconds, and (d) a repetition-number control portion which controls the inkjet recording head such that a number of said at least one more series falls in a range of from 4 to 7.

22. The recording system according to claim 20, comprising an inkjet printer including the inkjet recording head, wherein the control device comprises a computer which is operatively connected to the inkjet printer such that the computer controls the inkjet recording head to carry out the flushing method.

23. The recording system according to claim 20, wherein the inkjet recording head has a plurality of said nozzles including (a) a first nozzle which ejects a plurality of droplets of a first ink containing a pigment, and (b) a second nozzle which ejects a plurality of droplets of a second ink containing a dye, and wherein the flushing control portion controls the inkjet recording head to flush the first nozzle by carrying out the first flushing, and flush the second nozzle by carrying out a second flushing different from the first flushing.

* * * * *